United States Patent [19]

Hammes et al.

[11] 4,034,889

[45] July 12, 1977

[54] PLASTIC CONTAINER-COVER ASSEMBLY

[75] Inventors: Theo Hammes, Cologne; Wilhelm Kühne, Wiesenbach; Gerhard Gohlke, Bammental; Udo Hermann Maus, Mauer, Heidelberg, all of Germany

[73] Assignee: Mauser Kommanditgesellschaft, Bruhl, Germany

[21] Appl. No.: 657,108

[22] Filed: Feb. 11, 1976

[30] Foreign Application Priority Data

Oct. 3, 1975 Germany ..... 2544244

[51] Int. Cl.[2] ..... B65D 41/16; B65D 45/16

[52] U.S. Cl. ..... 220/306; 220/324

[58] Field of Search ..... 220/306, 307, 315, 324, 220/326

[56] References Cited

U.S. PATENT DOCUMENTS

| | | | |
|---|---|---|---|
| 3,383,009 | 5/1968 | Weikert | 220/324 X |
| 3,546,752 | 12/1970 | Sargent | 220/324 X |
| 3,767,110 | 10/1973 | Congleton | 220/324 X |
| 3,817,419 | 6/1974 | Moller et al. | 220/315 |

*Primary Examiner*—William Price

*Assistant Examiner*—Steven M. Pollard

*Attorney, Agent, or Firm*—Michael J. Striker

[57] ABSTRACT

A plastic container-cover assembly comprises (a) a container body having a top opening; (b) a first shoulder provided at the outside of the container close to the edge of its opening; (c) a cover for said opening; (d) an outside flange provided on said cover and extending downwardly and then at a sharp angle outwards, the outwardly pointed portion of the flange in the closed position abutting the upper side of said first container shoulder; (e) a hinge provided in proximity to the outer edge of said outwardly pointed portion of said flange; (f) at least two rigid closure flaps linked by said hinge to said flange for swinging from an open to a closed position; (g) a first ledge formed on said flap and, in the closed position, extending inwards and abutting against the bottom side of said first container shoulder; (h) a second, when closed, inwardly extending ledge formed on said flap spaced from said first ledge; (i) a second shoulder formed on the outside of said container spaced from said first shoulder, and (j) interlocking closure means formed on said second ledge of the flap and on the second shoulder of the container for securing the flap in the closed position.

7 Claims, 5 Drawing Figures

PLASTIC CONTAINER-COVER ASSEMBLY

BACKGROUND OF THE INVENTION

The invention relates to a plastic container of rectangular cross-sectional shape which has a sealable cover. The cover has a projecting inner flange which protrudes into the opening of the container and an outer flange which overlaps the upper edge of the container. Between the inner and outer flange a gasket is arranged which is pressed against the edge of the container. The cover is maintained in closed position by means of fastening means at the outside of the container and the outer rim of the cover.

In order to obtain a safe sealing of the comparatively elastic covers in case of rough handling, it has been necessary heretofore to provide for a multiplicity of fastening members distributed along the circumference of the cover. These fastening members had to be closed one by one and by hand by bringing them into contact with the lock devices provided on the wall of the container. To assure a high quality of seal the fastening members had to be secured moreover by a sealing wire.

In spite of this rather cumbersome lock procedure, sudden impact stresses resulted in a bending up of the edge of the cover between different fastening members and thus would cause a lifting of the seal. The reason was the distance between the individual fastening members which was particularly undesirable in case of the straight areas of the cover edge. The use of a special strap under tension to avoid this shortcoming proved rather expensive.

It is therefore an object of the present invention to obtain an adequate seal of the cover and at the same time to permit the sealing and closure operation to be carried out without loss of much time and with comparatively simple mechanical means.

SUMMARY OF THE INVENTION

This object is met by a plastic container-cover assembly which comprises a. a container body having a top opening;

b. a first shoulder provided at the outside of the container close to the edge of its opening;

c. a cover for said opening;

d. an outside flange provided on said cover and extending downwardly and then at a sharp angle outwards, the outwardly pointed portion of the flange in the closed position abutting the upper side of said first container shoulder;

e. a hinge provided in proximity to the outer edge of said outwardly pointed portion of said flange;

f. at least two rigid closure flaps linked by said hinge to said flange for swinging from an open to a closed position;

g. a first ledge formed on said flap and, in the closed position, extending inwards and abutting against the bottom side of said first container shoulder;

h. a second, when closed, inwardly extending ledge formed on said flap spaced from said first ledge;

i. a second shoulder formed on the outside of said container spaced from said first shoulder, and j. interlocking closure means formed on said second ledge of the flap and on the second shoulder of the container for securing the flap in the closed position.

DISCUSSION OF THE INVENTION AND A PREFERRED EMBODIMENT

Figure 1:
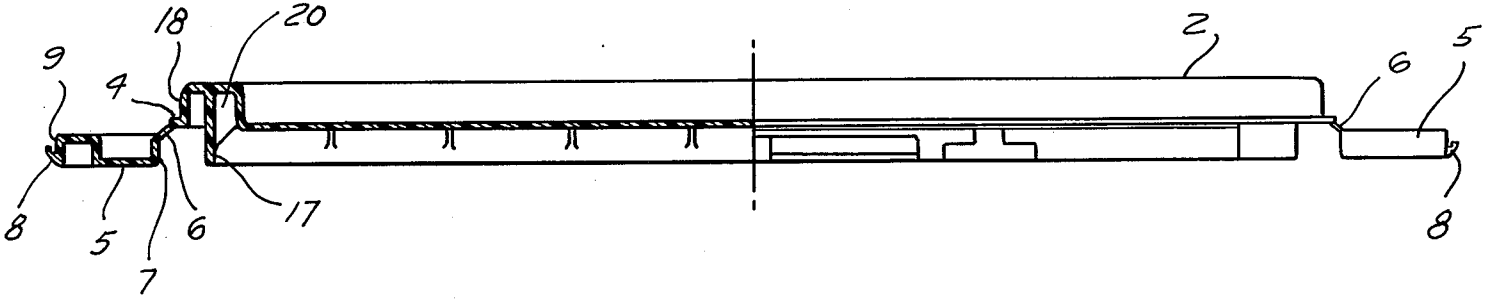
FIG. 1 shows a cover with closure flaps turned out, the cover being illustrated in a side view partly in section.
Figure 2:
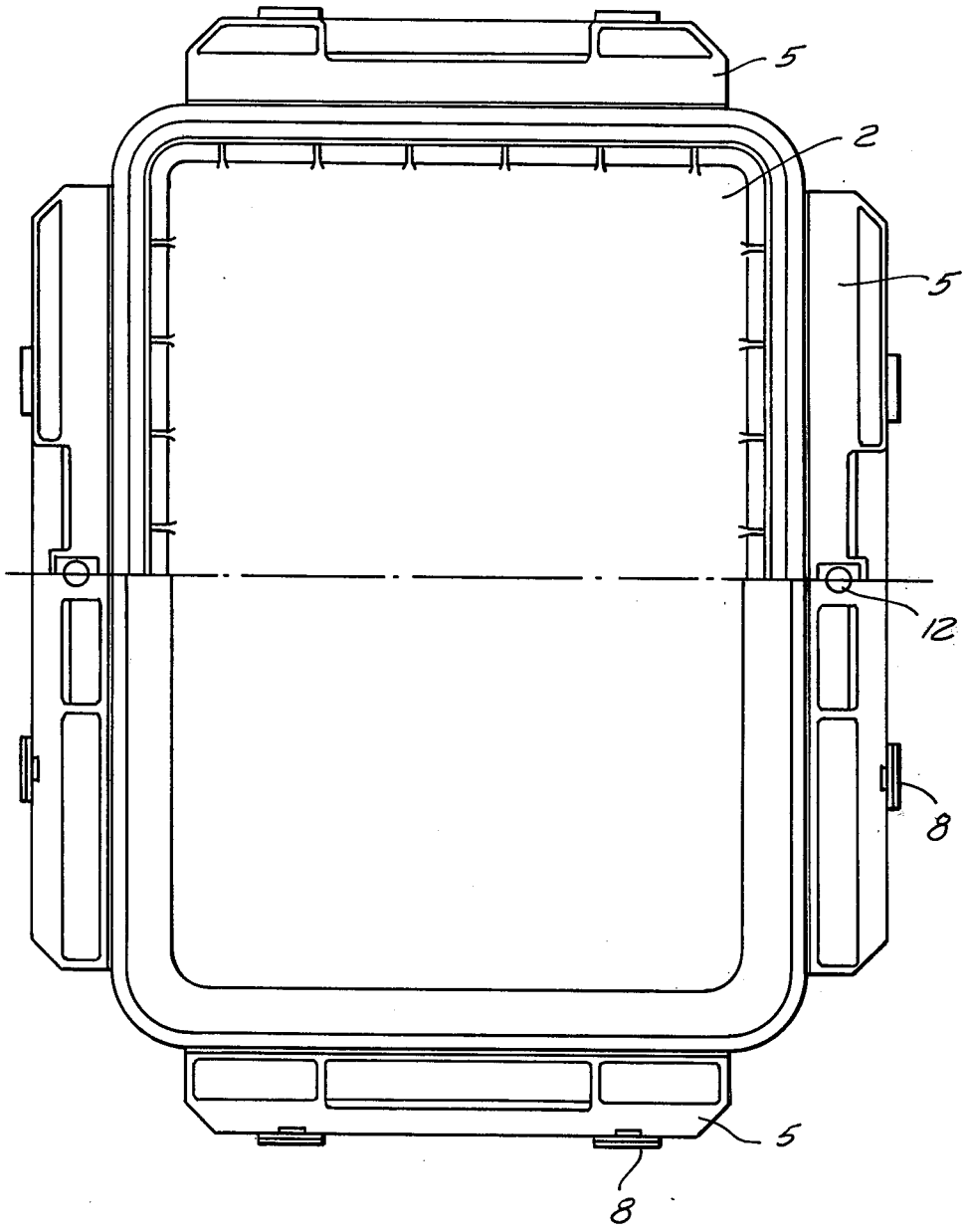
FIG. 2 shows a plan view of the cover of FIG. 1.
Figure 3:
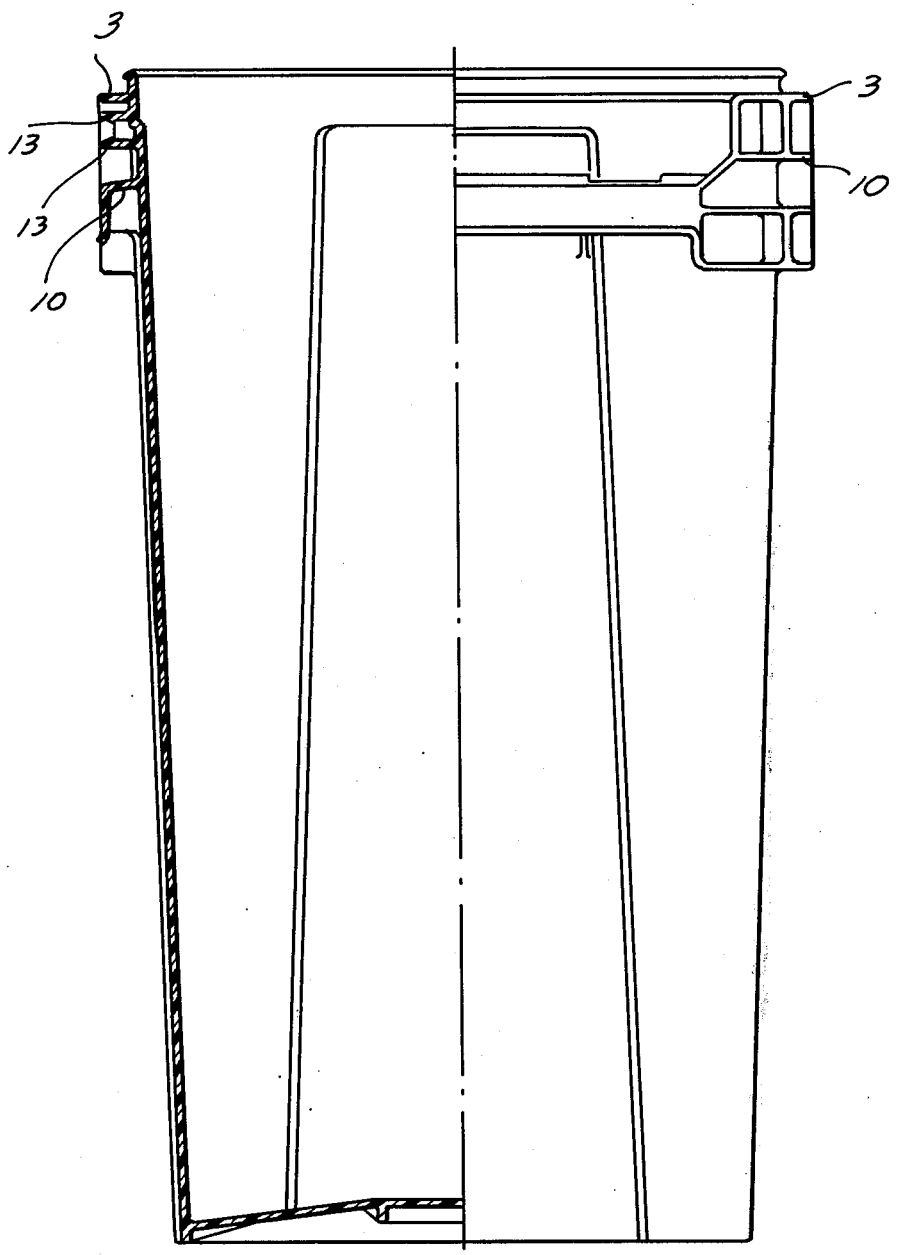
FIG. 3 shows a container without cover in side view and partly in section.

Closely below the edge of the opening of the rectangular container 1 two projecting shoulders 3 and 10 are provided on the outer wall of the container. By means of connecting ribs they form some kind of a box truss and thus reinforce the container opening; see particularly FIG. 3.

The plastic top 2 has an inner flange 17 which extends beyond the bottom of the top and is secured by reinforcing ribs 20 to the edge of the central depression of the cover. Parallel to the flange 17 an outer flange 18 is provided which has a portion 4 extending at a right angle outwardly. At the straight edges of the outwardly extending portion 4 film hinges 6 are provided which form pivots for the rigid closure flaps 5. When the flaps are turned out they permit the cover to be placed on the container or to be removed therefrom. On the flaps 5 ledges 7 and 9 are provided at opposite places spaced from each other. At two places of the ledge 9 sawtoothed shaped projections 8 are provided. A gasket 19 is secured by adhesive between the inner flange 17 and the outer flange 18 of the cover.

Figure 4:
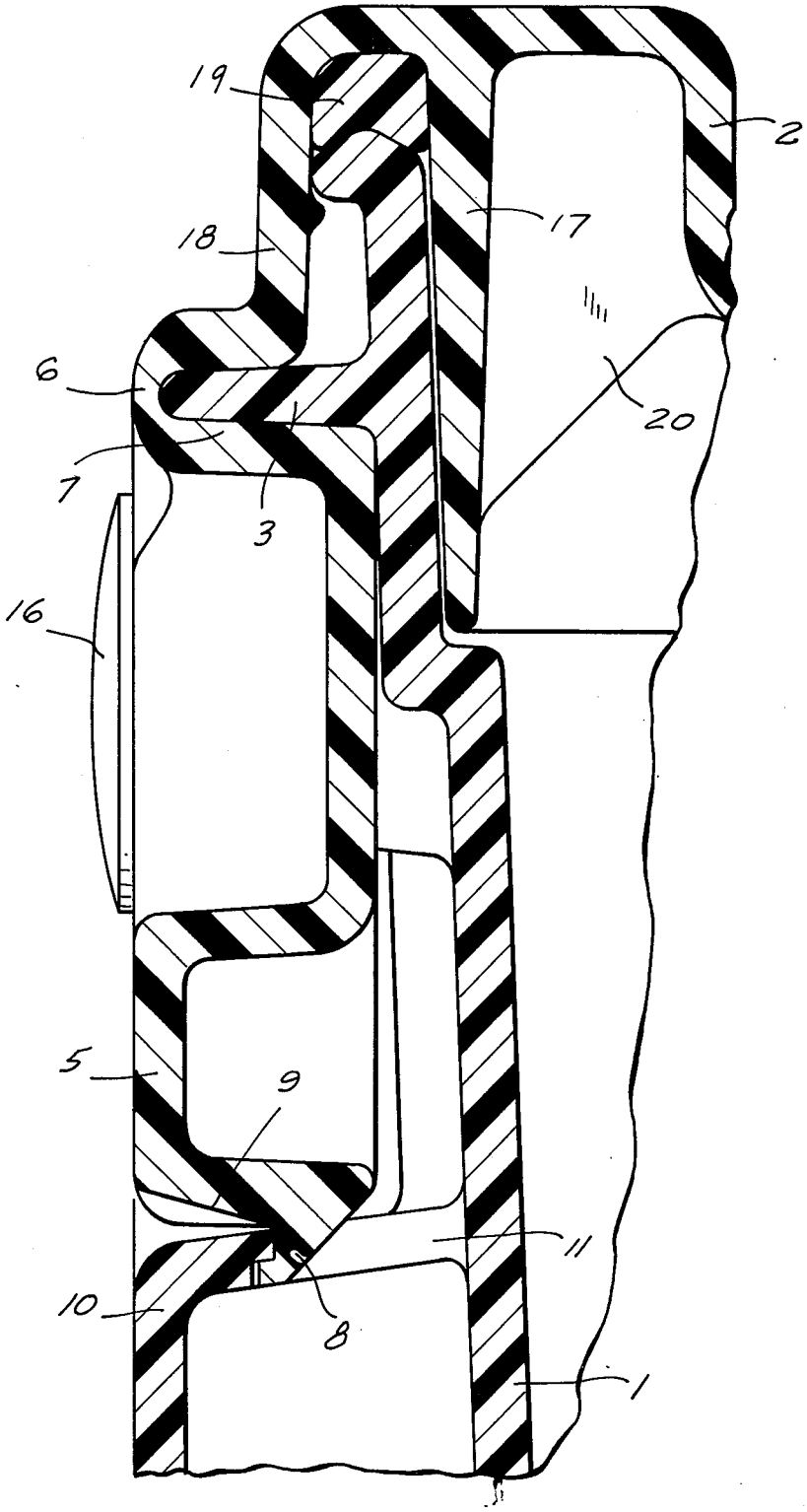
FIG. 4 is a partial section of a container with cover applied to it, the view being on an enlarged scale.
Figure 5:
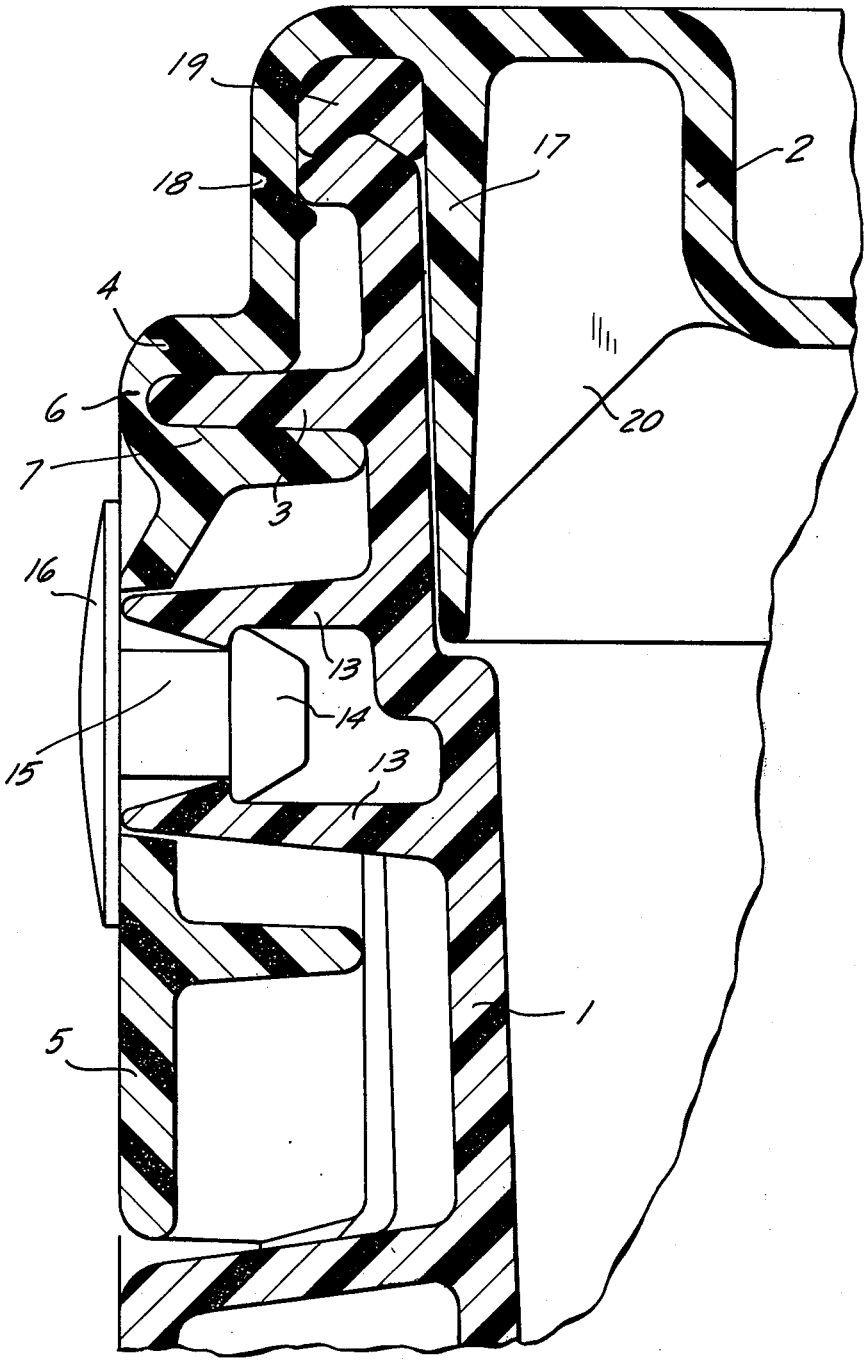
FIG. 5 is a similar partial section in the area of the locking rivets.

After placing the cover on the opening of the container as shown in FIGS. 4 and 5, the angled off portion 4 of the cover abuts the upper container shoulder 3. The edge of the container 1 is thus forced against the gasket.

After turning in the flaps 5 about hinges 6 into the closure position, the ledges 7 of the flaps abut against the bottom side of the container shoulder 3. In this position the sawtooth-shaped projections 8 which are provided at the inner edge of the ledges 9 mesh with notched portions 11 of the lower shoulder 10, see particularly FIG. 4.

In order to prevent an unauthorized opening of the container or to make such act immediately noticeable the following provisions are made.

At least two of the closure caps 5 are provided in their central area with bores 12. On the container are provided two corresponding pegs 13 which, when the closure flaps are in the closed position, extend through the bores 12. The pegs have ends in the form of sawtooths which mesh with the flat rear face of the mushroom-shaped shank 14 of sealing rivets 15. The rivet head 16 which can be knocked or blasted off abuts firmly against the outer wall of the particular closure flap 5.

In order to swing the closure flaps back into the open position, it is necessary to knock off or blow off the rivet heads which may have a conspicuous color. Thus, any change made in this respect will be immediately apparent.

It may be understood that with the device of the invention the particularly affected parts of the cover are well protected against opening-up of the closure. This is accomplished by the rigid or form stable closure flaps which extend almost along the entire length of the straight areas of the cover edge. The comparatively short corner areas, as has been shown by tests are strong enough to sustain a sudden surge of pressure. The closure operation itself is substantially shortened in time by the simple moving of the closure flaps. The same of course applies to the opening of the cover.

It will be understood that each of the elements described above, or two or more together, may also find a useful application in other types of constructions differing from the types described above.

While the invention has been illustrated and described as embodied in a plastic container-cover assembly, it is not intended to be limited to the details shown, since various modifications and structural changes may be made without departing in any way from the spirit of the present invention.

Without further analysis, the foregoing will so fully reveal the gist of the present invention that others can, be applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A plastic container-cover assembly comprising a. a container body having a top opening;

b. a first shoulder provided at the outside of the container close to the edge of its opening;

c. a cover for said opening;

d. an outside flange provided on said cover and extending downwardly and then at a sharp angle outwards, the outwardly pointed portion of the flange in the closed position abutting the upper side of said first container shoulder;

e. a hinge provided in proximity to the outer edge of said outwardly pointed portion of said flange;

f. at least two rigid closure flaps linked by said hinge to said flange for swinging from an open to a closed position;

g. a first ledge formed on said flap and, in the closed position, extending inwards and abutting against the bottom side of said first container shoulder;

h. a second, when closed, inwardly extending ledge formed on said flap spaced from said first ledge;

i. a second shoulder formed on the outside of said container spaced from said first shoulder, and j. interlocking closure means formed on said second ledge of the flap and on the second shoulder of the container for securing the flap in the closed position.

2. The container-cover assembly of claim 1 which includes an inside flange provided on said top for extending, in closed position, into the inside of the container and a gasket provided at the top edge of the container, the gasket, when the cover is applied to the container, being constrained between the inside and the outside flanges of the cover.

3. The container-cover assembly of claim 1 wherein the interlocking closure means comprise a sawtooth-shaped projection on the second ledge of the flap and a corresponding notch on the second shoulder of the container to receive the projection.

4. The container-cover assembly of claim 1 wherein the container has a rectangular cross-section and the flaps extend over the major portion of the straight areas of the container circumference.

5. The container-cover assembly of claim 1 which includes bores provided in at least two closure flaps; profiled pegs provided on the outside of the container; and fastening means adapted to be driven through said bores and to mesh with said profiled pegs in closed position of the flaps.

6. The container-cover assembly of claim 5 wherein the fastening means are in the form of rivets having shafts to mesh with the profiled pegs and having a bottom side which rests against the corresponding flap when the flap is closed.

7. The container-cover assembly of claim 6 wherein the pegs have sawtooth-like ends and the rivets have mushroom-like shaft ends, the shafts being adapted to be grabbed by said sawtooth-like ends of the pegs when in closed position.

* * * * *